United States Patent [19]

Oliverius

[11] 3,941,245

[45] Mar. 2, 1976

[54] STERILE CONTAINER FOR ENCLOSING A CONTAMINATED ARTICLE THEREIN

[76] Inventor: Maynard F. Oliverius, 4020 Sena Drive, Topeka, Kans. 66606

[22] Filed: Mar. 25, 1974

[21] Appl. No.: 454,761

[52] U.S. Cl. ..... 206/438; 128/292; 128/DIG. 24; 229/62

[51] Int. Cl.[2] ..... B65D 33/20

[58] Field of Search ..... 150/1, 3; 206/248, 438, 206/527; 229/53, 56, 62; 128/275, 292, 296, DIG. 24

[56] References Cited

UNITED STATES PATENTS

| | | | |
|---|---|---|---|
| 2,766,927 | 10/1956 | Wallace | 229/62 |
| 3,361,253 | 1/1968 | Lonholdt | 206/438 X |
| 3,471,871 | 10/1969 | Nociti et al. | 229/53 |
| 3,734,394 | 5/1973 | Dooley | 229/55 |
| 3,815,649 | 6/1974 | Delmar | 229/53 X |

*Primary Examiner*—William Price
*Assistant Examiner*—Steven E. Lipman
*Attorney, Agent, or Firm*—Fishburn, Gold & Litman

[57] ABSTRACT

A sterile container for enclosing contaminated or non-sterile material or article therein wherein the sterile container comprises walls defining a first or outer container which has a closed end and a cuff adjacent an open end of the outer container and in overlying relation with the walls of the first container and walls defining a second or inner container having a closed end releasably supported within said second or inner container having walls extending outwardly of the open-end of the outer container with a portion overlying a portion of said cuff to prevent contact of non-sterile material therewith. Enclosing non-sterile material or article in the sterile container includes holding the first or outer container by a sterile person while moving the non-sterile material or article into the second or inner container through the open end thereof by a second person. The material or article when engaged with the closed end of the inner container effecting bodily movement of the inner or second container into the first or outer container and then the sterile person holding the outer container sealing the outer or first container in a line or band outwardly of the inner container and article or material by exerting inwardly directed pressure on exterior surfaces of the container at said line or band to effect adhesive-to-adhesive contact between pressure-sensitive adhesive on facing surfaces of the wall portions of the outer or first container to thereby seal the material or article and second container within the outer or sterile container, said adhesive being characterized by adhering to like adhesive and resisting adhesion to other material such as material forming the containers.

11 Claims, 10 Drawing Figures

STERILE CONTAINER FOR ENCLOSING A CONTAMINATED ARTICLE THEREIN

The present invention relates to sterile containers and more particularly to a sterile container for enclosing a non-sterile material or article therein, an example of an article being an X-ray cassette.

Currently one of the problems associated with surgery is sterilization of X-ray cassettes which are in the form of film holders used when taking X-rays with either stationary or portable units. Sizes of X-ray cassettes vary from 8 inches × 10 inches to about 12 inches × 18 inches and weight up to 10 pounds. X-ray cassettes cannot be autoclaved due to heat and moisture problems and the effect thereof on the film. Exposing of the X-ray cassettes to ethylene oxide gas, which is another sterilizing agent, presents problems in addition to cost. Also ethylene oxide gas may create an adverse chemical reaction with the film thereby reducing its reproductive qualities. Use of ethylene oxide gas has been found to generate heat with the associated difficulties of heat with the X-ray film.

In surgery, a non-sterile X-ray cassette must be isolated from the sterile site or field of the operation. Heretofore, available containers were similar to plastic trash bags or sandwich bags. A third way to avoid contamination of the site or field of the operation was to place the dirty or contaminated X-ray cassette in a sterile pillow case, such as one which has been autoclaved. As a non-sterile person or nurse attempted to drop or move the contaminated or dirty cassette into the sterile bag, which was held open by a sterile nurse, the edges of the sterile bag were usually touched which would lead to contamination of other surfaces. The problem created is for the sterile nurse holding the respective bag or pillow case receiving the contaminated article to get all of the contaminated edges placed or rolled to the inside and to be assured she is not also contaminated or that portions of the exterior of the bag are not contaminated.

One solution of the problem is shown in my copending application on CASSETTE BAG, Ser. No. 284,412, filed Aug. 28, 1972, now U.S. Pat. No. 3,843,041. In the packaging shown therein a tubular member is releasably held in the container and protects same from contact with an article or material inserted therein and after the article or material is inside of the container, the tubular member is pulled out and discarded and the container is sealed adjacent the open end thereof. The present invention eliminates the removal of any portion. The protective portion or inner container moves into the outer container as the article or material completes its movement into the outer container, said protective portion on inner container moving inwardly beyond strips or a band of adhesive near the open end of the outer container to expose said adhesive which is pressed together forming an adhesive-to-adhesive bond sealing the outer container enclosing the non-sterile material or article with said outer container being characterized by absence of any exposed surface having had contact with the non-sterile material or article.

The principal objects of the invention are: to provide a sterile container adapted to receive a non-sterile or contaminated article therein which is operating room safe, namely formed of a material low in the generation of static electricity and free of particulate matter with no portions requiring disposal after moving non-sterile material or article therein; to provide such a sterile container for enclosing a non-sterile or contaminated article therein which is adapted to maintain exterior surfaces of the container sterile whereby sterile operating room personnel may position the container and the article enclosed therein next to an operative site with complete confidence that no contamination will be introduced into the field of the operation; to provide such a sterile container having portions thereof positioned in overlying or protective relation with respective walls of the sterile container adjacent an open end thereof whereby a sterile person may position their hands in engagement with exterior surfaces of the sterile or outer container and between the cuff and the sterile container; to provide such a sterile container wherein the cuff is maintained in a sterile condition before and after receiving a contaminated article within the sterile or outer container; to provide such a sterile container adapted to receive a contaminated article therein and which has means for effecting a positive closure of the container; and to provide such a sterile container adapted to receive a non-sterile or contaminated article therein which is economical to manufacture, simple to use, positive in operation, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include exemplary embodiments of the present invention and illustrate various objects and features of the sterile container for enclosing a contaminated article therein.

Figure 1:
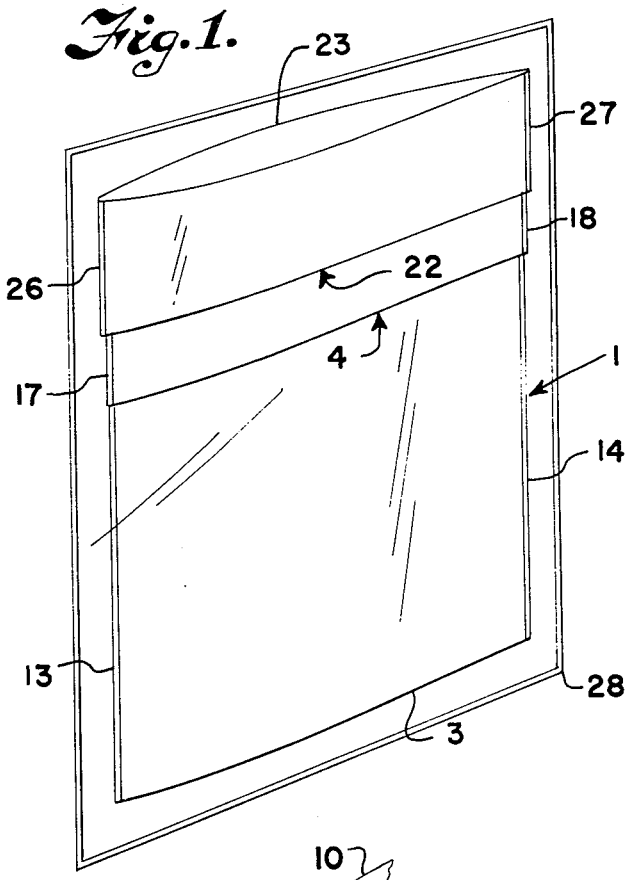
FIG. 1 is a perspective view of a sterile container embodying features of the present invention and shown enclosed within an outer package.
Figure 2:
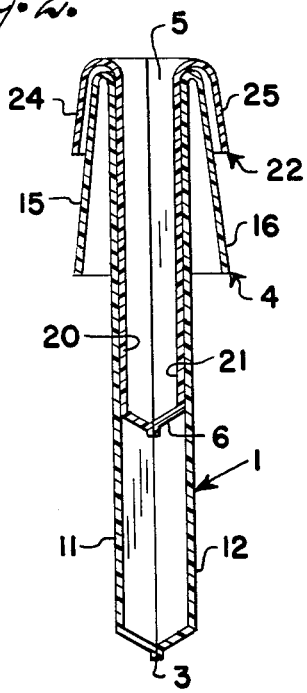
FIG. 2 is a transverse sectional view through the sterile container and showing the relative positions of the component parts.
Figure 3:
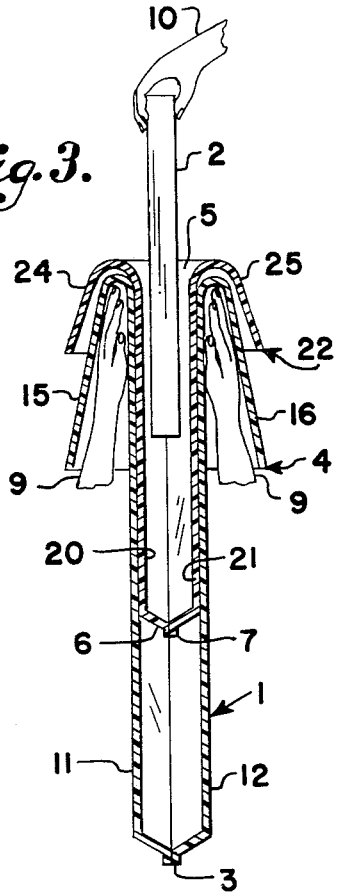
FIG. 3 is a transverse sectional view showing the sterile container held by a sterile person and a non-sterile or contaminated article or material being introduced into same by a second person.

Referring more in detail to the drawings:

As required, detailed embodiments of the present invention are disclosed herein. However, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

In the disclosed embodiment of the present invention, the reference numeral 1 generally designates a sterile container adapted to receive and enclose contaminated or non-sterile material or article 2 therein. The sterile container 1 has walls defining the sterile container 1 which has a closed end 3 and a cuff 4 adjacent an open end 5 thereof and in overlying relation with the walls of the sterile or outer container 1 are walls defining a second or inner container 6 having one end 7 thereof releasably supported within the open end 5 and in covering relation to strips or a band of adhesive 8 of the outer container 1 which is adapted to effect adhesive-to-adhesive sealing of the open end 5 after movement of the second or inner container 6 into the container 1 to thereby permit the contaminated or non-sterile material or article to be introduced into a sterile area. Enclosing the contaminated material or article 2 in the sterile container 1 includes holding the sterile or outer container 1 by a sterile person 9 while moving the contaminated or non-sterile article 2 into the second or inner container 6 by a second person 10 and effecting movement of the second or inner container 6 into the container 1 beyond the adhesive 8 and then sealing the sterile container 1 by exerting inwardly directed pressure on exterior surfaces of the outer container 1 to effect adhesive-to-adhesive contact between the pressure-sensitive adhesive 8 on facing surfaces of the walls of the outer container 1. The second container 6 has a cuff, as later described, folded outwardly over the cuff 4 of the outer container 1 whereby the second or inner container 6 is supported on the first or outer container 1 and such a manner that the adhesive 8 may be omitted or of a type which will only adhere to like adhesive.

The sterile outer container 1 may be any desired shape to substantially conform to the shape of the non-sterile or contaminated article 2 to be received and enclosed therein. In the illustrated embodiment, the sterile container 1 is substantially rectangular to receive a generally rectangular article 2 and has opposed side wall portions 11 and 12 suitably joined together along one edge thereof, as by heat sealing, to thereby define the closed end 3. Opposite side edges 13 and 14 of the side wall portions 11 and 12 are also suitably joined together, as by heat sealing, to define an elongated generally tubular receptacle or container having the bottom closed to form the closed end 3 and the sides closed and an open top or end 5.

The cuff 4 is preferably integral with the wall portions 11 and 12 of the sterile or outer container 1 and in the illustrated structure, the cuff 4 includes cuff portions or side walls 15 and 16 in overlying relation with the side walls 11 and 12 respectively of the container 1 and includes opposite side edges 17 and 18 suitably joined together, and also joined to underlying portions of the side edges 13 and 14 respectively of the outer container 1, as by heat sealing.

The container 1 and the cuff 4 is to be sealed after the article 2 is positioned therein and the closed and sealed container will be placed in a sterile environment, such as an operating room. It is desirable that the material of the wall portions of the container 1 and the cuff 4 be suitable for use in operating rooms. Therefore, said wall portions 11 and 12 and cuff portions 15 and 16 joined thereto are preferably formed of a non-woven fabric which is operating room safe, namely low in the generation of static electricity and substantially free of particulate matter which could enter an incision. Plastics, such as polyethylene, polyvinyl chloride and the like, have been found to provide satisfactory characteristics for the sterile container 1 and the cuff 4 when used in an operating room. Linen has also been found satisfactory for use in the sterile container 1.

The second or inner container 6 is illustrated as having opposed side wall portions defining a tubular member having the one or closed end 7 thereof positioned within the open end 5 of the outer container 1 and releasably supported. It is desirable to provide maximum insulation or separation between the article 2 and the cuff 4 and the exterior surfaces of the wall portions 11 and 12 of the outer container 1. Therefore, each of the wall portions of the inner container 6 are joined at one edge thereof, as by heat sealing, to define the closed end 7 which is positioned within the container 1 and adjacent the adhesive 8. In the illustrated embodiment, the second or inner container 6 has side walls 20 and 21 spaced from and in facing relation with the side wall portions 11 and 12 respectively of the outer container 1.

The side wall portions 20 and 21 of the second or inner container 6 are joined together at opposed side edges thereof, as by heat sealing, and the joined side edges extend from the closed end 7 of the inner container 6 and are adjacent the joined opposite side edges 13 and 14 of the side wall portions 11 and 12 of the outer container 1 to define an elongated generally tubular receptacle or container having an open top and of a size to fully receive the article 2 therein.

The second container 6 when positioned in the opening of the container 1 has portions of the side walls 20 and 21 extending from within the outer container 1 and in overlying relation with the cuff 4 to define a second or outer cuff 22 which is positioned to protect the cuff 4 and the outer container 1 from contact with the non-sterile article 2 when moved into the second or inner container 6 through an open end 23 thereof. In the illustrated embodiment, the second or outer cuff 22 is formed of side wall portions 24 and 25 in surrounding and overlying relation with portions of the cuff 4 adjacent the open end of the container 1.

The adhesive 8 is mounted on interior surfaces of the wall portions of the outer container 1 and is in a continuous band spaced inwardly from the open end 5 and spaced from the closed end 3 of the container 1 a distance greater than the length of the second container 6 so the adhesive is exposed when an article 2 and the second container moves into the container 1. The adhesive 8 is preferably of the pressure-sensitive type which will adhere to itself, such as when the adhesive on the side wall 11 is moved into engagement with the adhesive on the side wall 12 to thereby effect sealing of the open end 5 of the sterile or outer container 1, as shown in FIG. 5.

The sterile container 1 is preferably packaged and sealed within an outer package 28 which is also preferably formed of a material which is safe for use in operating rooms, such as non-woven plastic fabrics including polyethylene, polyvinyl chloride, and the like. The outer package 28 preferably has wall portions formed of a material which will substantially resist movement into the package of any agent which will contaminate an article therein, therefore, the wall portions of the outer package 28 are formed of a suitable non-woven fabric, such as paper, polyethylene, polyvinyl chloride, and the like.

It is desirable that the outer container 28 be sealed in a manner which will maintain the interior surfaces thereof and an article therein in a sterile condition and which may be opened in a manner to maintain the interior surfaces of the outer package 28 and the sterile container 1 in a sterile condition particularly during removal of the sterile container 1 from the outer package 28. Heat sealing of plastic to plastic and plastic to paper have been found to provide such a seal which can be opened by a non-sterile person while maintaining the sterile container 1 in a sterile condition.

Figure 5:
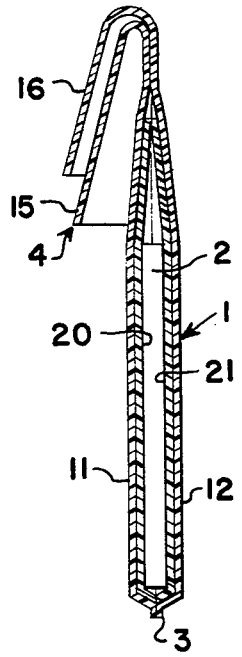
FIG. 5 is a transverse sectional view showing the sealed sterile container with a cuff folded for use in sterile area.
Figure 4:
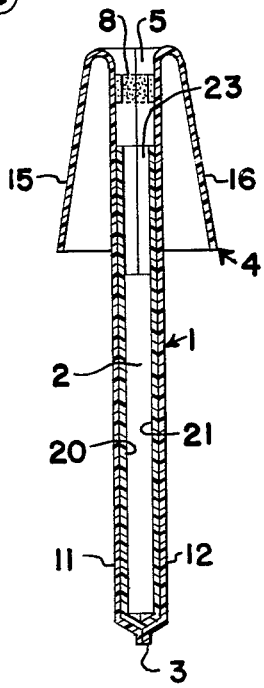
FIG. 4 is a transverse sectional view similar to FIGS. 2 and 3 except showing the contaminated article or non-sterile material received within the sterile container after bodily movement of an inner container into an outer or sterile container.

Using a sterile container for enclosing a contaminated or non-sterile article or material therein which is constructed as illustrated in FIGS. 1 to 5 inclusive and described is effective to enclose the article 2 within the container 1 without contaminating exterior surfaces of the sterile container 1 and the cuff portion 4 or a sterile person holding same. The sterile outer package 28 is opened by any suitable person, such as a circulating nurse, and the sterile container 1 is dumped onto a sterile field, such as a sterile table covered with a sterile sheet or the like. The sterile container 1 is removed from the sterile field or removed from the sterile outer package 28 by the sterile person 9 who then holds the container 1 by placing their hands on or adjacent exterior surfaces of the wall portions, more particularly, the side walls 11 and 12 of the outer container 1 and under the cuff 4 with at least the tips of the fingers in supporting engagement with the cuff 4. The container 1, so supported, is adapted to receive the article 2 which is moved thereinto by the second person 10 by moving the article 2 through the open end 23 of the second container 6. The material or article 2 may come into engagement with exposed surfaces of the inner side walls 20 and 21 of the inner or second container 6. After the material or article 2 is moved into the container 1, the inner container 6 is then separated from the container 1 by the weight of the article 2 in the second container 6 while the sterile person 9 holds the sterile container 1. FIG. 4 illustrates the inner container 6 and the article 2 within the outer container 1 after separation of the inner container 6 from the container 1. The possible areas of contamination are facing surfaces of the inner side wall portions 20 and 21 of the inner container 6 and exterior surfaces of the second or outer cuff 22 where gripped or contacted by the second person 10 during placing the article in the second container 6. After the second container 6 has been separated from the outer container 1, the sterile container 1 having the inner container 6 and the contaminated article 2 therein is sealed by the sterile person 9 by exerting inwardly directed pressure on exterior surfaces of the wall portions of the container 1, more particularly, on the side walls 11 and 12 to thereby effect adhesive-to-adhesive contact between the pressure-sensitive adhesive 8 on facing interior surfaces of said side walls 11 and 12 to effect a continuous seal of the container 1 by closing the formerly open end 5. After the outer container 1 has been sealed by the sterile person 9, one of the cuff portions 15 and 16 is folded to a position overlying the other cuff portion of the cuff 4, as shown in FIG. 5, and thereby effect an additional seal of the formerly open end 5.

The sterile container 1 is particularly adapted for receiving X-ray cassettes of a size in the range of 8 inches × 10 inches to approximately 12 inches and 18 inches, whereby the X-ray cassette or contaminated article 2 may be taken from a non-sterile area by the second person 10 and placed in the sterile container 1 while the container 1 is held by the sterile person 9, who after sealing the formerly open end 5, may place the container and cassette adjacent or in contact with an area to be X-rayed without fear of contamination of the patient and without the necessity to sterilize the X-ray cassettes.

FIGS. 6 to 10 inclusive illustrate another form of the sterile container for receiving and enclosing a contaminated article 2 therein. A modified sterile container has wall portions defining the sterile container 30 which has closed ends and sides. The container 30 is folded to form an outer container 31 and a cuff 32 and an inner container 33 having an open end 34. Enclosing the contaminated material or article 2 in the sterile container 30 includes holding the sterile container 30 by the sterile person 9 while moving the contaminated material or article 2 into the sterile container 30 through the open end 34 of the inner container 33 by the second person 10 which moves the material or article 2 and the inner container 33 into the outer container 31 while the sterile person 9 holds the sterile container and then sealing the sterile container 30 by exerting inwardly directed pressure on exterior surfaces of the outer container 31 to effect adhesive-to-adhesive contact between pressure-sensitive adhesive 35 on facing surfaces of the wall portions of the inner container 31.

Figure 8:
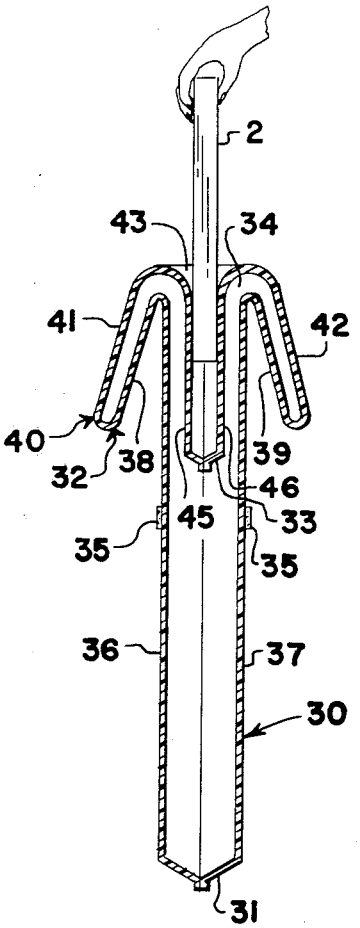
FIG. 8 is a transverse sectional view through the modified sterile container and showing the components in position to receive a non-sterile article or material therein.

The sterile container 30 may be any desired shape to substantially conform to the shape of the contaminated article 2 to be received and enclosed therein. In the illustrated embodiment, the sterile container 30 is substantially rectangular to receive a generally rectangular non-sterile article 2 and the outer container 31, as best seen in FIG. 8, has opposed side walls 36 and 37 suitably joined together along edges thereof, as by heat sealing, to thereby define a closed end and sides to define an elongated generally tubular receptacle or container.

The cuff portion 32 is preferably integral with the wall portions of the sterile outer container 31 and in the illustrated structure, the cuff 32 includes cuff portions 38 and 39 spaced from and in overlying relation with the side walls 36 and 37 respectively of the outer container 31 and the cuff 32 includes opposite side edges joined together and spaced from and in overlying relation with respective side edges of the outer container 31.

The modified sterile container 30 is folded to form a second cuff 40 integral with and in overlying relation with the cuff 32 extending from the outer container 31. The second cuff 40 extends from and is integral with the second or inner container 33. The illustrated second cuff 40 includes cuff portions 41 and 42 spaced from and integral with and in overlying relation with the cuff portions 38 and 39 respectively of the first cuff 32 and includes opposite side edges joined together and spaced from and in overlying relation with respective side edges of the first cuff 32.

The container 31 and the cuff portions 32 and 40 are to be sealed after the article 2 is positioned therein and the closed and sealed container will be placed in a sterile environment, such as an operating room. It is desirable that the material of the wall portions of the container 30 be suitable for use in operating rooms. Therefore, said wall portions are preferably formed of a non-woven fabric which is operating room safe, namely low in the generation of static electricity and substantially free of particulate matter which could enter an incision. Plastics, such as polyethylene, polyvinyl chloride and the like have been found to provide satisfactory characteristics for the sterile container 1 and the cuff portion 4 when used in an operating room. Linen has also been found satisfactory for use in the sterile container 1.

The second or inner container 33 is illustrated as having wall portions defining a tubular member having one end portion 43 thereof positioned within the open end of the container 31. It is desirable to provide maximum insulation or separation between the material or article 2 and the exterior surfaces of the wall portions 36 and 37 of the container 31. Therefore, each of the wall portions of the inner container 33 are joined at the edges thereof, as by heat sealing, to define a closed end 44 which is positioned within the container 31. In the illustrated embodiment, the second or inner container 33 has side walls 45 and 47 spaced from and in facing relation with the side walls 36 and 37 respectively of the outer container 31. The side wall portions 45 and 46 of the inner container 33 are joined together at opposed side edges thereof, as by heat sealing, and the joined side edges extend from the closed end 44 of the inner container 33 to the joined side edges of the second cuff 40 and are adjacent the joined side edges of the outer container 31 to define an elongated generally tubular receptacle or container having the bottom 44 and opposite sides closed to receive the article 2 through the open end 34 thereof.

Figure 9:
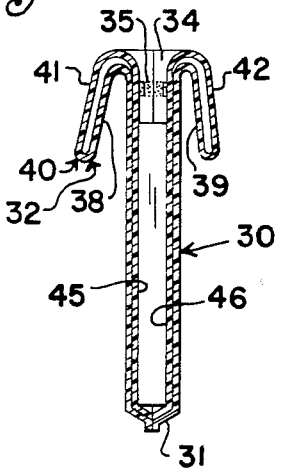
FIG. 9 is a transverse sectional view through the modified sterile container and showing the components after receiving the non-sterile article or material therein.
Figure 10:
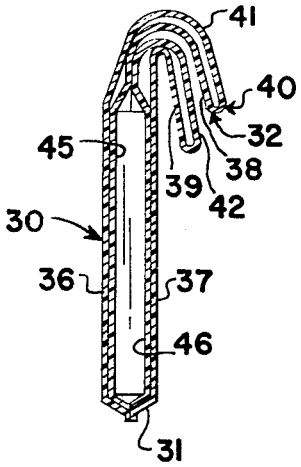
FIG. 10 is a transverse sectional view through the modified sterile container and showing same sealed and the components in position for introduction into a sterile area.

When the components are in the position shown in FIG. 9, the adhesive 35 is mounted on interior surfaces of the wall portions 45 and 46 of the inner container 33 and in a continuous band spaced inwardly from the open end 34. The adhesive 35 is preferably of the pressure-sensitive type which will adhere to itself, such as when the adhesive on the side wall 45 is moved into engagement with the adhesive on the side wall 46 to thereby effect sealing of the open end 5 of the sterile container 30, as best seen in FIG. 10.

The sterile container 30 is preferably packaged and sealed within an outer package which is also preferably formed of a material which is safe for use in operating rooms, such as non-woven plastic fabrics including polyethlene, polyvinyl chloride and the like. The outer package preferably has wall portions formed of a material which will substantially resist movement into the package of any agent which will contaminate an article therein, therefore, the wall portions of the outer package are formed of a suitable non-woven fabric, such as paper, polyethylene, polyvinyl chloride, and the like.

It is desirable that the outer container be sealed in a manner which will maintain the interior surfaces thereof and an article therein in a sterile condition and which may be opened in a manner to maintain the interior surfaces of the outer package and the sterile container 30 in a sterile condition particularly during removal of the sterile container 30 from the outer package. Heat sealing of plastic to plastic and plastic to paper have been found to provide such a seal which can be opened by a non-sterile person while maintaining the sterile container 30 in a sterile condition.

Using a modified sterile container for enclosing a contaminated or non-sterile article therein and which is constructed as illustrated in FIGS. 6 to 10 inclusive and described herein is effective to enclose the material or article 2 within the container 30 without contaminating exterior surfaces of the sterile container 30 and the cuffs 32 and 40 or a sterile person holding same. The sterile outer package is opened by any suitable person, such as a circulating nurse, and the sterile container 30 is dumped onto a sterile field, such as a sterile table covered with a sterile sheet or the like. The sterile container 30 is removed from the sterile field or removed from the sterile outer package by the sterile person 9 who then holds the container 1 by placing their hands on or adjacent exterior surfaces of the wall portions, more particularly, the side walls 36 and 37 of the outer container 31 and under the cuffs 32 and 40 with at least the tips of the fingers in supporting engagement with the cuff 32. The container 31, so supported, is adapted to receive the material or article 2 which is moved into the second or inner container 33 by the second person 10 by moving the article 2 through the open end 34. The material or article 2 may come into engagement with exposed surfaces of the inner side walls 45 and 46 of the inner container 33. After the material or article 2 is moved into the inner container 33, the weight of the material or article 2 moves the components to the position shown in FIG. 9 while the sterile person 9 holds the sterile container 30. The possible areas of contamination are facing surfaces of the inner side walls 45 and 46 of the inner container 33 and exterior surfaces of walls where gripped by the second person 10 during placing the article 2 in the container. After the components are in the position shown in FIG. 9, the sterile container 30 having the contaminated material or article therein is sealed by the sterile person 9 by exerting inwardly directed pressure on exterior surfaces of the wall portions of the container 31, more particularly, on the side walls 36 and 37 to thereby effect adhesive-to-adhesive contact between the pressure-sensitive adhesive 35 on facing interior surfaces of said side walls 45 and 46.

Figure 6:
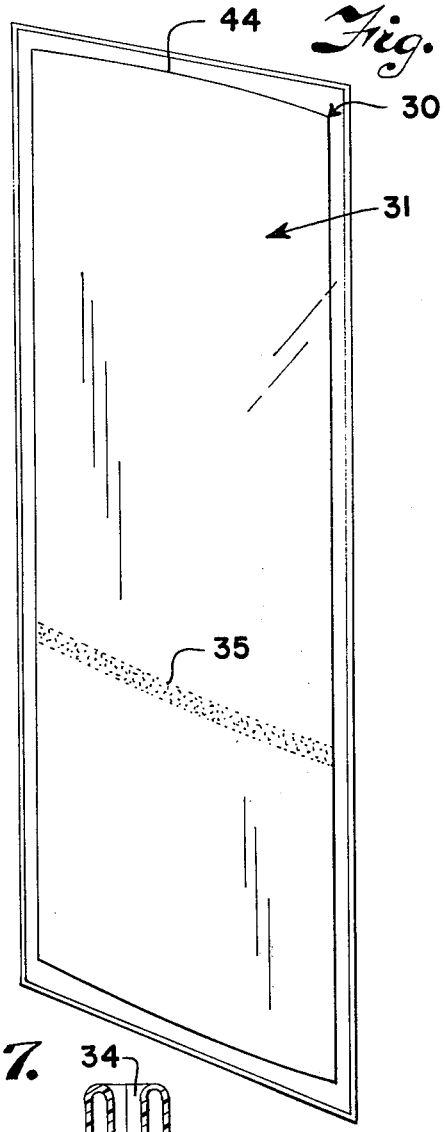
FIG. 6 is a perspective view of a modified sterile container prior to positioning the components thereof to receive a non-sterile article or material.
Figure 7:
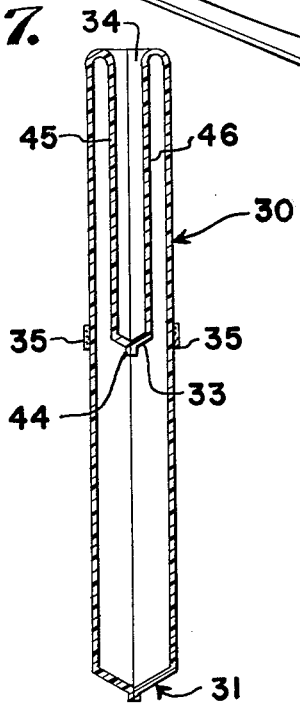
FIG. 7 is a transverse sectional view through the modified sterile container and showing a first position of the components thereof.

Folding of the modified sterile container is illustrated in FIGS. 7 and 8 wherein an upper edge of the sterile container 30 is folded into the sterile container 30 to define the inner container 33 and the outer container 31, as best seen in FIG. 7. Upper portions of the side walls of the inner and outer containers are then folded to define the cuffs, 32 and 40, as best seen in FIG. 8. Weight of the article 2 moves the inner container 33 to a position having the bottom edge thereof into engagement with the bottom edge of the outer container 31. The adhesive 35 is thereby moved from a position as shown in FIG. 6 to a position on interior facing surfaces of the side walls 45 and 46 of the inner container 33 so that the sterile container 30 may then be sealed as previously described. After the sterile container has been sealed by the sterile person 9, one of the adjacent pair of cuff portions, for example cuff portions 38 and 41, is folded to a position overlying the other adjacent pair of cuff portions 39 and 42 and thereby effect an additional seal of the formerly open end 34.

It is to be understood that while I have illustrated and described certain forms of my invention, it is not to be limited to these specific forms or arrangement of parts herein described and shown.

What I claim and desire to secure by letters patent is:

1. A sterile container adapted to receive a non-sterile article and comprising:

a. walls defining a container having a closed end and an open end, said container having closed sides;

b. a cuff on said container and in overlying relation with said walls adjacent the open end of said container;

c. walls defining a second container having a closed end and an open end, said second container having the closed end thereof positioned within said first named container, said walls of said second container extending from within said first named container and having outer portions thereof in overlying relation with said cuff adjacent the open end of said first named container whereby said walls of said second container protect said first named container and said cuff from contact with a non-sterile article moved into said first named container; and d. means on said walls of one of said first named container and said second container for sealing said first named container whereby a non-sterile article moved into said second container may be sealed in said first named container after movement of said second container and article into said first named container to thereby provide a sterile package of a non-sterile article which may then be safely introduced into a sterile area.

2. A sterile container as set forth in claim 1 wherein:

a. the non-sterile article which said second container and said first named container is adapted to receive is an X-ray cassette; and b. said first named container and said cuff are each formed of a non-woven plastic fabric characterized by being substantially free of static electricity whereby the sterile package is adapted to be safely introduced into an operating room.

3. A sterile container as set forth in claim 1 wherein:

a. said means for sealing said first named container is positioned on said walls of said first named container;

b. said means on said walls of said first named container are operative for releasably supporting the closed end of said second container in the open end of said first named container and comprises adhesive in a band inside of said first named container adjacent the open end thereof and underlying said walls defining said second container; and c. said adhesive is pressure-sensitive whereby said walls of said first named container may be sealed together by adhesive-to-adhesive contact after movement of said second container and article into said first named container.

4. A sterile container as set forth in claim 1 wherein:

a. said walls of said first named container comprise first and second wall portions in facing relation;

b. said cuff comprises a first cuff portion overlying said first wall portion and a second cuff portion overlying said second wall portion;

c. said first cuff portion and said second cuff portion each have opposite side edges thereof secured to said first wall portion and said second wall portion of said first named container; and d. one of said first and second cuff portions is adapted to be folded to a position overlying the other of said first and second cuff portions after movement of said second container and article into said first named container.

5. A sterile container as set forth in claim 1 wherein:

a. said cuff is integral with said walls of said first named container and extends from the open end thereof;

b. said outer portions of said walls defining said second container are integral with said cuff thereby defining a second cuff;

c. said means for sealing said first named container comprises adhesive in a band inside said second container adjacent the open end thereof; and d. said adhesive is pressure-sensitive whereby said wall portions of said second container may be sealed together by adhesive to adhesive contact after the non-sterile article has been placed therein.

6. A sterile container as set forth in claim 5 wherein:

a. the non-sterile article which said second container is adapted to receive is an X-ray cassette; and b. said first named container and said first named cuff and said second cuff and said second container are each formed of a non-woven plastic fabric characterized by being substantially free of static electricity whereby the sterile package is adapted to be safely introduced into an operating room.

7. A sterile container as set forth in claim 1 wherein:

a. said second container is of a size to receive the entire non-sterile article therein and to have the open end thereof spaced from the non-sterile article;

b. said means for sealing said first named container is positioned on said walls of said first named container; and c. said first named container is of a size to receive said second container with the non-sterile article therein and have the open end of said second container spaced from said means for sealing said first named container.

8. A sterile container adapted to receive a non-sterile article an comprising:

a. walls defining a container having a closed end and closed sides;

b. a cuff on said container and in overlying relation with said walls, said cuff being spaced from the closed end of said container;

c. a second cuff positioned in overlying relation with said first named cuff, said second cuff being connected to said first named cuff;

d. walls defining a second container connected to said second cuff, said second container having an open end adjacent said second cuff and a closed end adjacent the closed end of said first named container; and e. means on said walls of said second container for sealing said second container after a non-sterile article has been placed therein to thereby provide a sterile package of a non-sterile article which may then be safely introduced into a sterile area.

9. A sterile container as set forth in claim 8 wherein:

a. said walls defining said first named container are integral with said first named cuff;

b. said second cuff is integral with said first named cuff; and c. said second cuff is integral with said walls defining said second container.

10. A sterile container as set forth in claim 9 wherein:

a. said walls defining said second container comprise first and second wall portions in facing relation;

b. said walls defining said first named container comprise a first wall portion overlying said first wall portion of said second container and a second wall portion overlying said second wall portion of said second container;

c. said first named cuff comprises a first cuff portion overlying said first wall portion of said first named container and a second cuff portion overlying said second wall portion of said first named container; and d. said second cuff comprises a first cuff portion overlying said first cuff portion of said first named cuff and a second cuff portion overlying said second cuff portion of said first named cuff.

11. A sterile container as set forth in claim 10 wherein one of said first and second cuff portions of said second cuff and the respective first and second cuff portion of said first named cuff is adapted to be folded to a position overlying the other of said first and second cuff portions of said second cuff and the respective first and second cuff portion of said first named cuff after movement of said article into said second container.

* * * * *